US006889393B1

(12) United States Patent
Rinaldo

(10) Patent No.: US 6,889,393 B1
(45) Date of Patent: May 10, 2005

(54) COMBINED PORTABLE STOOL AND TOILET

(76) Inventor: Jim Rinaldo, 160 Rte. 108, Rumford, ME (US) 04276

( * ) Notice: Subject to any disclaimer, the term of this patent is extended or adjusted under 35 U.S.C. 154(b) by 91 days.

(21) Appl. No.: 10/615,271

(22) Filed: Jul. 9, 2003

(51) Int. Cl.[7] ..... A47K 11/06
(52) U.S. Cl. ..... 4/484
(58) Field of Search ..... 4/480, 483, 484, 4/460, 242.1; 297/16.2, 18

(56) References Cited

U.S. PATENT DOCUMENTS

| | | | | |
|---|---|---|---|---|
| 701,826 A | * | 6/1902 | Amerman et al. | 4/480 |
| 1,521,740 A | * | 1/1925 | Wernli et al. | 4/484 |
| 2,507,609 A | * | 5/1950 | Miles | 297/423.26 |
| 3,105,665 A | * | 10/1963 | Starkweather | 248/101 |
| 4,475,627 A | | 10/1984 | Eastridge | |
| 5,876,091 A | * | 3/1999 | Chernomashentsev | 297/16.2 |
| 6,061,845 A | | 5/2000 | Kakutani | |
| 6,062,638 A | | 5/2000 | Ferguson | |
| 6,176,545 B1 | | 1/2001 | Hambleton | |
| 6,240,576 B1 | | 6/2001 | Cosby | |
| 6,286,154 B1 | | 9/2001 | Pitts | |
| 6,389,612 B1 | | 5/2002 | Harris | |
| 6,647,560 B1 | * | 11/2003 | Hingley et al. | 4/484 |

FOREIGN PATENT DOCUMENTS

JP 408224191 A * 9/1996

* cited by examiner

*Primary Examiner*—Charles E. Phillips

(57) ABSTRACT

A combined portable stool and toilet includes a frame selectively positionable between folded and unfolded positions. The combined stool and toilet further includes a seat member removably connectable to the frame for allowing a user to sit thereon. The seat member has an aperture formed therein for receiving a bag therethrough wherein a portion of a bag is disposed above and over a perimeter of the aperture so that when a user sits thereon the bag will be maintained in place by the weight of a user. Advantageously, a user to may displace excretions downwardly into the bag while seated on the present invention. The apparatus may further include a seat cover removably connected to the frame and foldable over the aperture for covering same. The apparatus may further include Velcro for assisting to maintain the seat cover at a folded position.

17 Claims, 3 Drawing Sheets

COMBINED PORTABLE STOOL AND TOILET

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to portable toilets and, more particularly, to a combined portable stool and toilet including an aperture for receiving a bag to collect excretions while a user is seated thereon.

2. Prior Art

Currently, when hunting, watching an outdoor sporting event such as golf, working on a vehicle, grooming an animal, or performing other, mostly, outdoor activities, a person typically stands or crouches with no support. The need to stand or crouch in one place for an extended period of time to watch an event, to hunt or fish, or to perform some other activity can create a great deal of stress and strain on a person's lower back and legs.

The stress and strain placed on the person's lower back and legs while standing or crouching to watch an event, hunt, fish or perform some other activity reduces the amount of time the person can enjoyably spend watching the event or performing the activity and may prevent some individuals, with physical impairments such as lower back and leg problems, from participating in such activities.

People who want to sit on a chair or stool during recreational activities outside typically have an array of chairs and stools to select from. Folding lawn chairs are useful when the outdoor activity is close to home and where compactness is not a problem. When there is a concern for compactness or portability, folding stools, e.g., folding chairs with no back thereon have been used. Also, outdoorsmen have used plastic buckets of the type used to package paint or the like because they are cheap and light to carry.

These buckets are simply turned upside down and placed on the ground to sit on and can be moved from place to place. Neither of these solutions is particularly compact and those having activities outside sometimes have other things to carry, so the need for compactness is viewed as very important, for example for activities such as hunting, fishing and gardening where other articles also need to be carried to participate in the activity as well as the stool to be used.

Furthermore, it is often difficult to relieve one's self from their excrements when there are no available restrooms in the vicinity. Outdoorsmen are often required to squat or sit on the ground, which can be uncomfortable and unsanitary. A secluded spot where there is privacy if often needed so that other persons do not become offended by foul smell or the act of using the restroom. Also, a small shovel is often required to dig a hole and cover up the excrement. Such shortcomings provide inconvenience and difficulty for outdoorsmen.

BRIEF SUMMARY OF THE INVENTION

In view of the foregoing background, it is therefore an object of the present invention to provide a portable toilet than can be more conveniently and sanitarily used in the outdoors. These and other objects, features, and advantages of the invention are provided by a combined portable stool and toilet including a frame selectively positionable between folded and unfolded positions. The apparatus further includes a seat member removably connectable to the frame for allowing a user to sit thereon.

The seat member has an aperture formed therein for receiving a bag therethrough wherein a portion of a bag is disposed above and over a perimeter of the aperture so that when a user sits thereon the bag will be maintained in place by the weight of a user. Advantageously, a user may displace excretions downwardly into the bag while seated on the stool. The apparatus may further include a seat cover removably connected to the frame and foldable over the aperture for covering same. The apparatus may further include Velcro for assisting to maintain the seat cover at a folded position.

The frame includes a first plurality of elongate leg members having opposed top and bottom end portions and being removably connectable to each other generally medially thereof. Similarly, a second plurality of elongate leg members also have opposed top and bottom end portions and are removably connectable to each other generally medially thereof. The first and second pair of leg members are spaced from each other.

The frame may further include a plurality of elongate connector members having opposed end portions removably connectable between the top portions of the first and second plurality of leg members respectively. An elongate support member has opposed end portions removably connected to one of the first plurality of leg members and one of the second plurality of leg member respectively. Such a support member assists to maintain the frame at an unfolded position.

The seat member is preferably connected to the plurality of connecter members and is disposed therebetween. The apparatus may further include a carrying case so that after disassembly, the apparatus can be stored in the carrying case during non-use conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
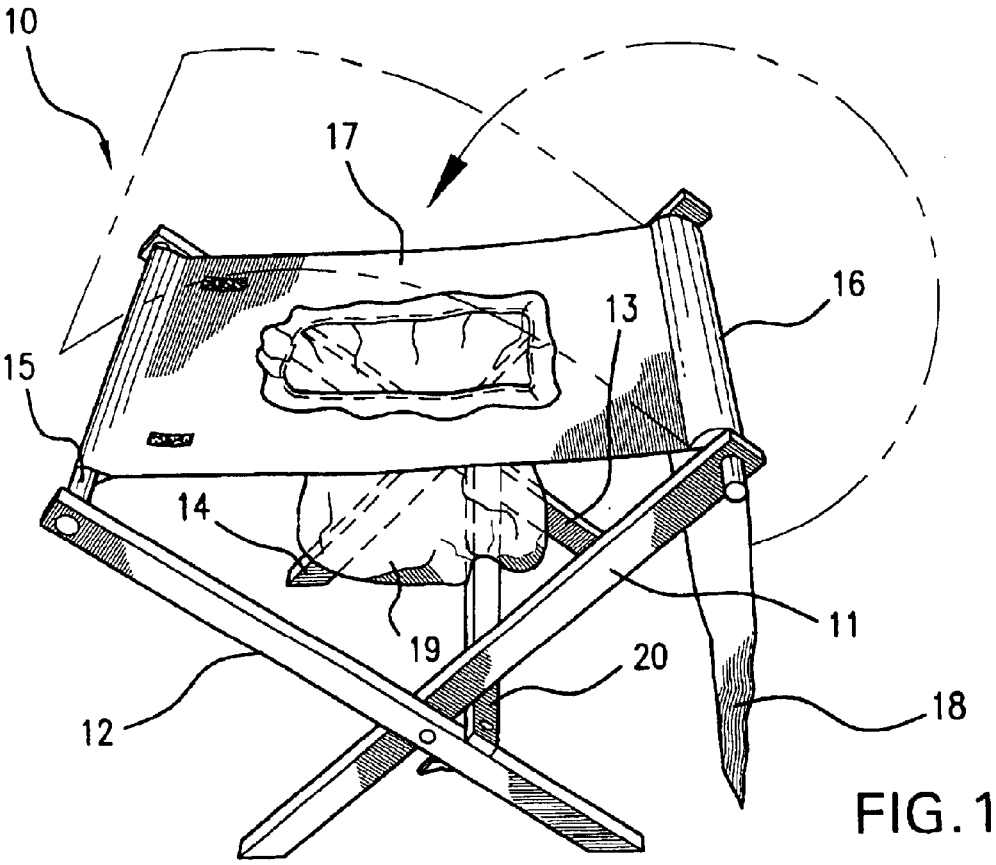
FIG. 1 is a perspective view showing a combined portable stool and toilet, in accordance with the present invention.
Figure 2:
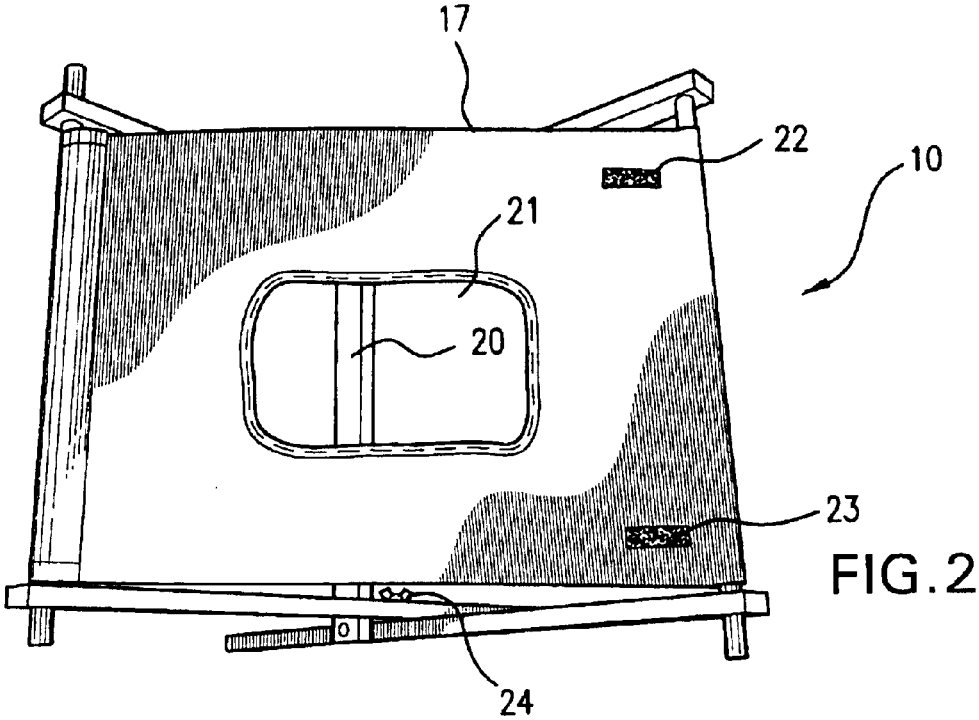
FIG. 2 is top plan view of the apparatus shown in FIG. 1.

The apparatus of this invention is referred to generally in FIG. 1 by the reference numeral 10 and is intended to provide a combined portable stool and toilet seat for outdoor use. It should be understood that the apparatus 10 also may be used indoors and, therefore, is not limited to only outdoor use.

The apparatus 10 includes of frame including a first plurality of elongate leg members 11, 12. Such leg members are connected to each other via a fastener such as a conventional bolt and wing nut 24, as well known in the industry. In particular, leg members 11, 12 are connected to each other generally medially of their respective lengths. Similarly, a second plurality of elongate leg members 13, 14 are spaced apart from leg members 11, 12 and are disposed in a substantially similar orientation.

A pair of connector members 15, 16 have opposing end portions connected to the top end portions of the respective leg members 11–14. Such connector members 15, 16 define the depth of the apparatus 10 and help maintain same at a stable position. For further stability, support member 20 has opposing end portions connected to leg members 12, 13 and is engaged with leg members 11, 14. Accordingly, when a user sits on the apparatus 10, a portion of the downward force, which is transferred from the leg members 11–14 onto support member 20 as well as between the connector members 15, 16, can be supported so that the apparatus 10 can be maintained at an unfolded position.

The apparatus 10 further includes a seat member 17 preferably made from waterproof material and connected to the connector members 15, 16. Such a seat member 17 defines the area onto which a user may sit and further has an aperture 21 formed therein and spaced generally medially from its outer edges. Such an aperture 21 is preferably large enough for allowing human excretions to pass therethrough without unwanted scattering thereof.

A disposable and conventional waste bag 19 has an upper end portion positioned therethrough and folded about aperture 21 so that the top end portion of bag 19 extends outwardly from the perimeter of aperture 21. Accordingly, when a user sits on the seat member 17, the waste bag 19 may be securely maintained in place by the weight of the user. Such a waste bag 19 is intended to collect human excretions while a user is seated on the apparatus 10, and may be buried after use. Of course, waste bag 19 is preferably made from waterproof material for effectively maintaining excrements therein.

The apparatus 10 may further include a seat cover 18 also preferably formed from waterproof material and movable between covered and uncovered positions, as clearly shown in FIG. 1. Accordingly, seat cover 18 may be folded over aperture 21 and secured in place by hook and loop material members 22, 23 when a user does not need to use the restroom.

Figure 3:
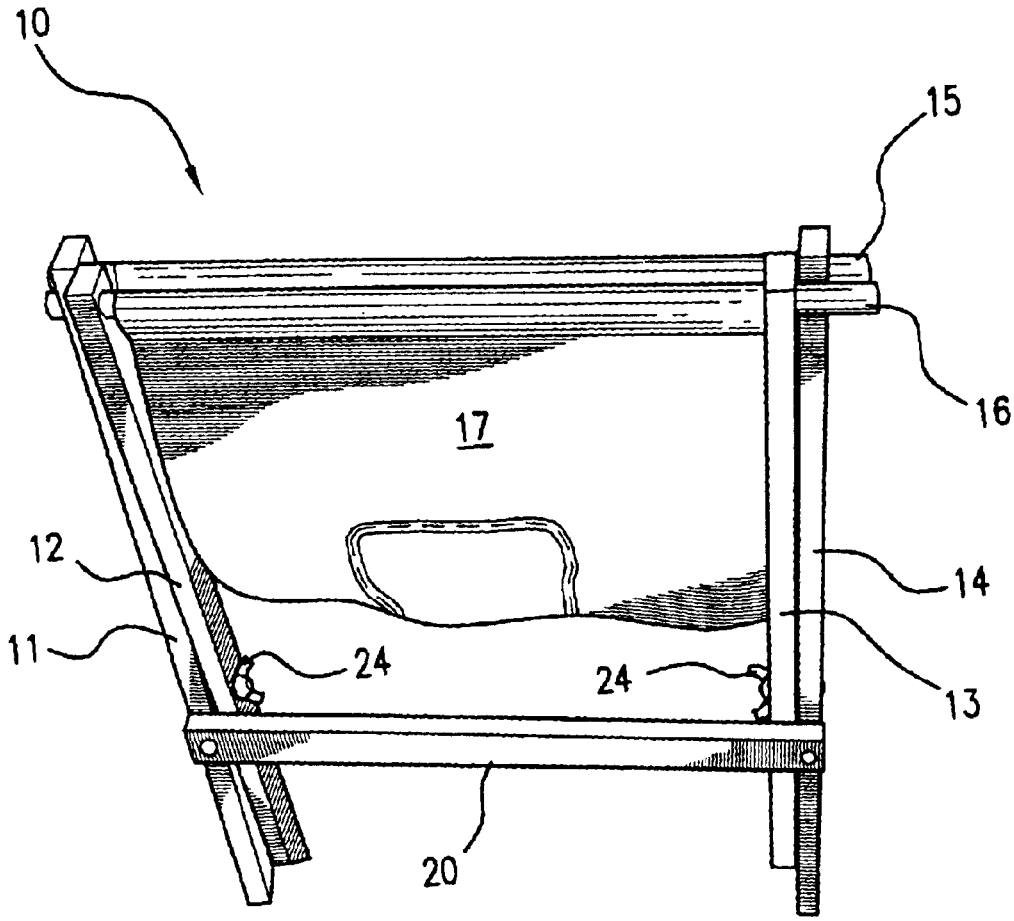
FIG. 3 is a perspective view of FIG. 1 showing the present invention at a folded position.
Figure 4:
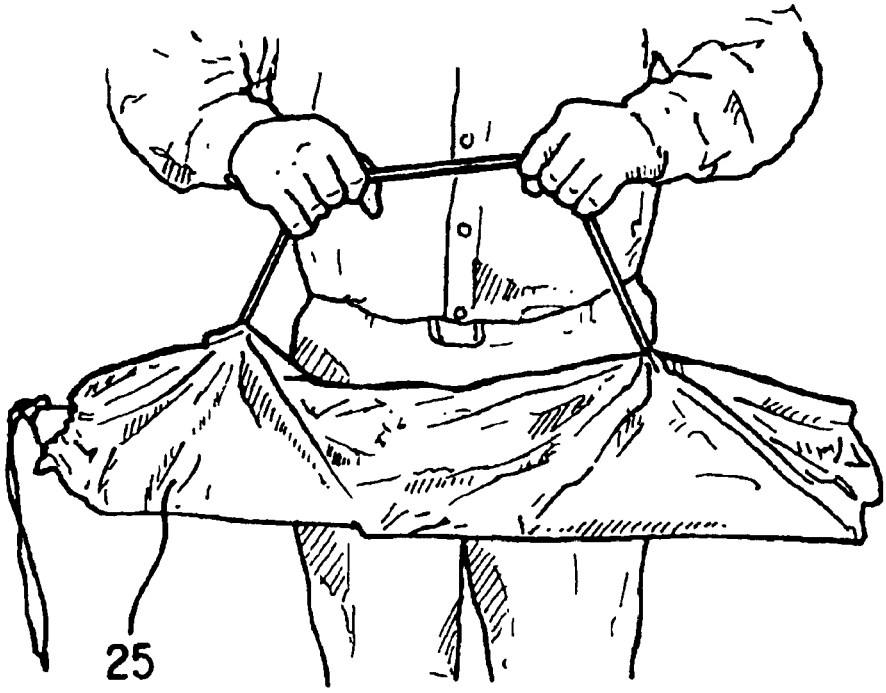
FIG. 4 is a perspective view wherein the present invention has been disassembled and placed within a carrying case.

Now referring to FIGS. 3 and 4, the apparatus 10 is shown at a folded position whereby it can be easily stored during non-operating conditions. Advantageously, by simply unscrewing the conventional bolts and wing nuts 24, the apparatus 10 may be readily and easily disassembled. Afterwards, the elements of the apparatus 10 may be gathered in a substantially parallel pattern so that they may be placed within a carrying case 25 during transportation thereof.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A portable stool comprising:

a frame selectively positionable between folded and unfolded positions;

a seat member removably connectable to said frame for allowing a user to sit thereon, said seat member having an aperture formed therein and for receiving a bag therethrough wherein a portion of a bag is disposed above and over a perimeter of said aperture so that when a user sits thereon said bag will be maintained in place by the weight of a user thereby allowing a user to displace excretions downwardly into a bag while seated on said stool;

a first plurality of elongate leg members each having opposed top and bottom end portions and being removably connectable to each other generally medially thereof:

a second plurality of elongate leg members each having opposed top and bottom end portions and being removably connectable to each other generally medially thereof, said first and second pair of lea members being spaced from each other;

a plurality of elongate connector members having opposed end portions removably connectable between said top portions of said first and second plurality of leg members respectively; and an elongate support member having opposed end portions removably connected to one said first plurality of leg members and one said second plurality of leg member respectively, said support member assisting to maintain said frame at an unfolded position.

2. The stool of claim 1, further comprising a seat cover removably connected to said frame and being foldable over said aperture for covering same.

3. The stool of claim 1, wherein said seat member is connected to said plurality of connecter members and is disposed therebetween.

4. The stool of claim 2, wherein said seat cover is connected to one said plurality of connector members.

5. The stool of claim 2, further comprising means for assisting to maintain said seat cover at a folded position.

6. The stool of claim 5, wherein said maintaining means comprises hook and loop material.

7. The stool of claim 1, further comprising a carrying case, said stool able to be disassembled and stored in said carrying case during non-use conditions.

8. A portable toilet comprising:

a frame selectively positionable between folded and unfolded positions;

a seat member removably connectable to said frame for allowing a user to sit thereon, said seat member having an aperture formed therein and for receiving a bag therethrough wherein a portion of a bag is disposed above and over a perimeter of said aperture so that when a user sits thereon said bag will be maintained in place by the weight of a user thereby allowing a user to displace excretions downwardly into a bag while seated on said stool;

a seat cover removably connected to said frame and being foldable over said aperture for covering same;

a first plurality of elongate leg members each having opposed top and bottom end portions and being removably connectable to each other generally medially thereof;

a second plurality of elongate leg members each having opposed top and bottom end portions and being removably connectable to each other generally medially thereof, said first and second pair of leg members being spaced from each other;

a plurality of elongate connector members having opposed end portions removably connectable between said top portions of said first and second plurality of leg members respectively; and an elongate support member having opposed end portions removably connected to one said first plurality of leg members and one said second plurality of leg member respectively, said support member assisting to maintain said frame at an unfolded position.

9. The toilet of claim 8, wherein said seat member is connected to said plurality of connecter members and is disposed therebetween.

10. The toilet of claim 8, wherein said seat cover is connected to one said plurality of connector members.

11. The toilet of claim 8, further comprising means for assisting to maintain said seat cover at a folded position.

12. The toilet of claim 11, wherein said maintaining means comprises hook and loop material.

13. The toilet of claim 8, further comprising a carrying case, said stool able to be disassembled and stored in said carrying case during non-use conditions.

14. A combined portable stool and toilet comprising:

a frame selectively positionable between folded and unfolded positions;

a seat member removably connectable to said frame for allowing a user to sit thereon, said seat member having an aperture formed therein and for receiving a bag therethrough wherein a portion of a bag is disposed above and over a perimeter of said aperture so that when a user sits thereon said bag will be maintained in place by the weight of a user thereby allowing a user to displace excretions downwardly into a bag while seated on said stool;

a seat cover removably connected to said frame and being foldable over said aperture for covering same;

means for assisting to maintain said seat cover at a folded position;

a first plurality of elongate leg members each having opposed top and bottom end portions and being removably connectable to each other generally medially thereof:

a second plurality of elongate leg members each having opposed top and bottom end portions and being removably connectable to each other generally medially thereof, said first and second pair of leg members being spaced from each other:

a plurality of elongate connector members having opposed end portions removably connectable between said top portions of said first and second plurality of leg members respectively; and an elongate support member having opposed end portions removably connected to one said first plurality of leg members and one said second plurality of leg member respectively said support member assisting to maintain said frame at an unfolded position.

15. The combined portable stool and toilet of claim 14, wherein said seat member is connected to said plurality of connecter members and is disposed therebetween.

16. The combined portable stool and toilet of claim 14, wherein said maintaining means comprises hook and loop material.

17. The combined portable stool and toilet of claim 14, further comprising a carrying case, said stool able to be disassembled and stored in said carrying case during non-use conditions.

* * * * *